United States Patent [19]

Crasnianski

[11] 4,257,323

[45] Mar. 24, 1981

[54] MULTI-PURPOSE PRINTING MACHINE

[75] Inventor: Serge Crasnianski, Meylan, France

[73] Assignee: Kis France, Grenoble, France

[21] Appl. No.: 79,099

[22] Filed: Sep. 26, 1979

[30] Foreign Application Priority Data

Oct. 5, 1978 [FR] France ..... 78 28494

[51] Int. Cl.[3] ..... B41F 17/00

[52] U.S. Cl. ..... 101/41; 101/292; 101/314; 101/329; 101/407 BP; 219/216

[58] Field of Search ..... 101/4–6, 101/8–9, 22, 23, 25, 27, 31, 35, 36, 41, 42–43, 212, 250, 282, 287, 295, 93.37, 93.41, 327, 329, 407 R, 407 BP; 219/216

[56] References Cited

U.S. PATENT DOCUMENTS

| | | | |
|---|---|---|---|
| 2,148,563 | 2/1939 | Kingsley | 101/407 BP |
| 2,218,227 | 10/1940 | Winnek | 101/25 X |
| 2,374.089 | 4/1945 | Freeman et al. | 101/27 |
| 3,092,024 | 6/1963 | Wagner | 101/407 R X |
| 3,094,922 | 6/1963 | Crane | 101/4 X |
| 4,193,343 | 3/1980 | Ackley, Sr. et al. | 101/35 |
| 4,196,664 | 4/1980 | Crasnianski | 101/DIG. 4 |

FOREIGN PATENT DOCUMENTS

| | | | |
|---|---|---|---|
| 2219913 | 10/1973 | Fed. Rep. of Germany | 101/27 |
| 2722687 | 11/1978 | Fed. Rep. of Germany | 101/9 |

*Primary Examiner*—E. H. Eickholt

*Attorney, Agent, or Firm*—Frishauf, Holtz, Goodman & Woodward

[57] ABSTRACT

The invention relates to a printing machine which makes it possible to effect ink or dry letterpress printing of different objects or to make moulds for stamps.

The invention provides a printing machine having a movable head which carries a printing unit and a support for holding objects to be printed. The movable head is designed to receive different accessories, such as an inking device, and the support is designed to receive different platens according to the object to be printed. The invention is applicable to manual or automatic printing machines.

20 Claims, 22 Drawing Figures

MULTI-PURPOSE PRINTING MACHINE

FIELD OF THE INVENTION

The present invention relates to a multi-purpose printing machine, that is to say a machine which makes it possible to carry out ink or dry letterpress printing on various supports, or to make moulds for stamps.

BACKGROUND TO THE INVENTION

Printing machines which are used at present for printing visiting cards, making stamps, printing advertising matchboxes or any other object are designed for only one specific use: ink letterpress printing, dry printing, or the making of moulds for stamps. Furthermore, it is sometimes necessary to have different machines available in each category to correspond to the type of object to be printed, such as labels, cigarette lighters, pens, and so on. The printer must therefore have a number of machines, so that the amount of his investment and consequently the final cost of his services are increased.

SUMMARY OF THE INVENTION

One of the aims of the present invention is to provide a printing machine which in a single machine combines all the features of a plurality of machines according to the prior art, and which therefore permits ink or dry letterpress printing on different objects and the making of moulds for stamps.

Printing machines which are used by craftsmen are in general of the manual type and are therefore not suitable for long runs because of the time required for the latter. Nevertheless, the desire for profitability leads to the seeking out of long runs because, as these machines are often complicated, making them ready is lengthy and delicate, requiring the services of a specialist the cost of whose labour becomes prohibitive for short runs.

Thus, another aim of the present invention is to provide a multi-purpose printing machine of the automatic or semi-automatic type the operation of which is simple.

The present invention therefore has as its object a multi-purpose printing machine which comprises principally a head designed to receive different accessories and a support designed for receiving the object to be printed as well as other accessories, the head being made movable by a driving device in such a manner as to come into contact with the support in order to effect the printing of the object.

The movable head comprises a frame supporting an electric heating plate, a device having slides and designed to receive the printing head, which may be a unit for letterpress type, a printing block unit, or a pressure unit; further comprises an adjusting device which permits the truing up of the said unit and the adjustment of the pressure to be applied for the printing, and a safety device.

The frame of the movable head is designed to permit the fastening of a certain number of accessories in accordance with the work which is to be done, such as an inking device and a film unwinding device.

The support, which is inclined in relation to the horizontal plane, is composed of a frame designed to receive a certain number of accessories in accordance with the work to be done, such as a platen for printing sheets of all sizes, a platen for printing various objects, a platen for making moulds, an automatic distributor charger for visiting cards, and a label unwinding device.

DETAILED DESCRIPTION

Figure 1:
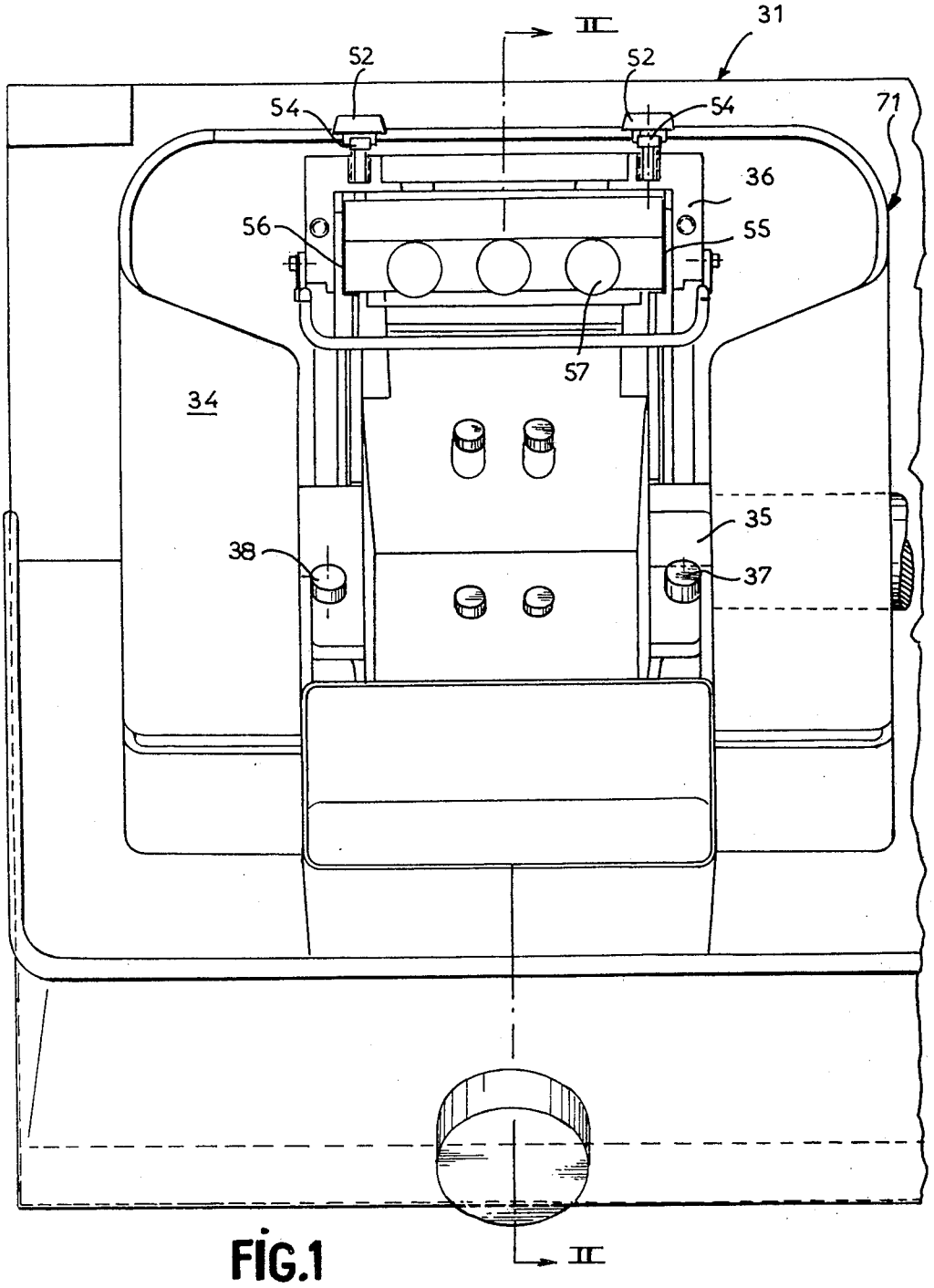
FIG. 1 is a front view of a printing machine according to the present invention.

The printing machine according to the present invention comprises a so-called basic machine, which will be described with reference to FIGS. 1 to 4, and a certain number of accessories which will be described with reference to FIGS. 5 to 9 in the case of accessories fastened to the movable printing head, and with reference to FIGS. 10 to 22 in the case of accessories intended for engaging in the suppport.

In FIGS. 1 to 4, the basic machine is composed of a frame 31 which carries on the one hand the press frame 32 and on the other hand a panel (not shown) grouping together the operating and adjustment controls. The frame 32 is fixed to the frame 31 by screw bolts, such as those given the reference 33. The actual press, given the reference 34, comprises two parts, one being a fixed part 35 called seat or support, and the other a movable part 36 called movable head. The seat or support 35 is disposed on a falling slope on the top face of the frame 32, and is provided with two magnets 37 and 38 used for the centring and fastening of the various accessories which will be described below with reference to FIGS. 10 to 22. These magnets 37 and 38 are fixed to two lateral uprights 39 and 40 of the seat, the side faces 41 and 42 of which uprights are provided with ejection levers 43 and 44 respectively for the accessories, these levers being articulated about screws 45 and 46 respectively which are screwed into the frame 32.

The movable head 36 is composed of a metal structure 47 which swivels on a shaft 48 held at its ends in bearings 49 and 50 which are fixed to the frame 32. The metal structure 47 supports at its bottom part a heating unit 51 connected to a source of electric energy (not shown). The connection between the structure 47 and the heating unit is a semi-elastic connection made with the aid of four screws 52 which oppose the force of four springs 53 held by four screws 54. This semi-elastic connection permits the truing of the heating unit and the adjustment of the pressure to be applied for printing.

The heating unit 51 carries on its bottom face a drawer composed of slides 55 and 56; this drawer can receive a certain number of printing units, such as a letterpress type carrier unit, a printing block support unit, or the like. These printing units are provided with clamp screws 57.

The angular displacement of the movable head 36 around the shaft 48 is effected with the aid of a motor 58 acting through the medium of a reduction device 59 and a system of connecting rods and cranks 60, 61, 62, 63, and 64. The angular displacement may also be effected with the aid of a knurled wheel 65 fastened to the shaft 67 of the rotor of the motor 58 by a screw 68. The motor 58 and the reduction gear 59 are fixed to the frame 31 by screws 69 and 70 respectively.

In order to provide safety for the operator, the apparatus is provided on the one hand with an enclosing casing 71, while on the other hand it is provided with a sectional member 72 which is articulated on the movable head around screws 73 and which cooperates with two microcontacts 74 fixed on the head. These microcontacts control the switching off of the motor 58 every time the said sectional member 72 is touched, particularly by the operator's hand.

Figure 2:
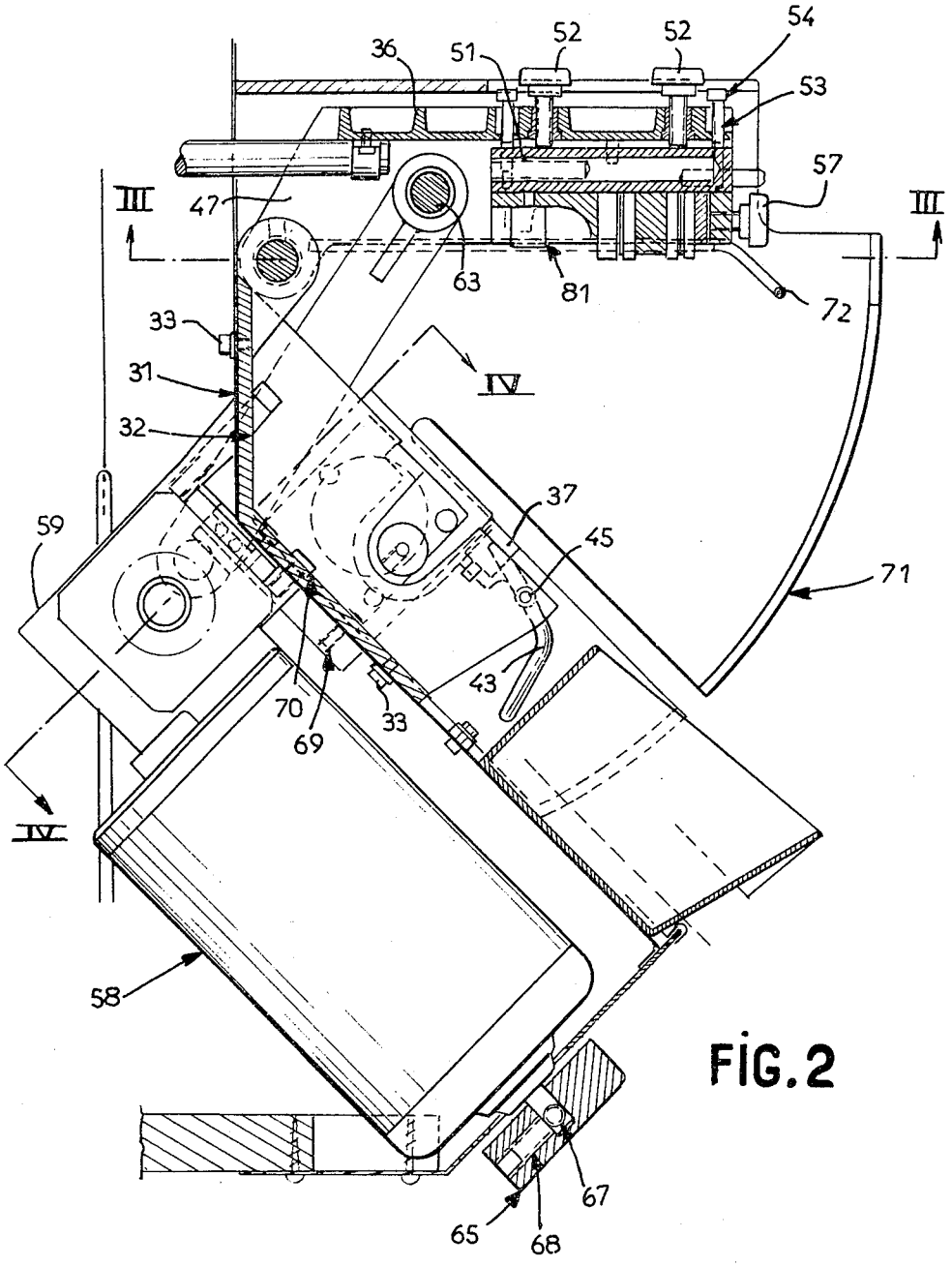
FIG. 2 is a view in section of the printing machine of the present invention, taken on the line II—II in FIG. 1.
Figure 3:
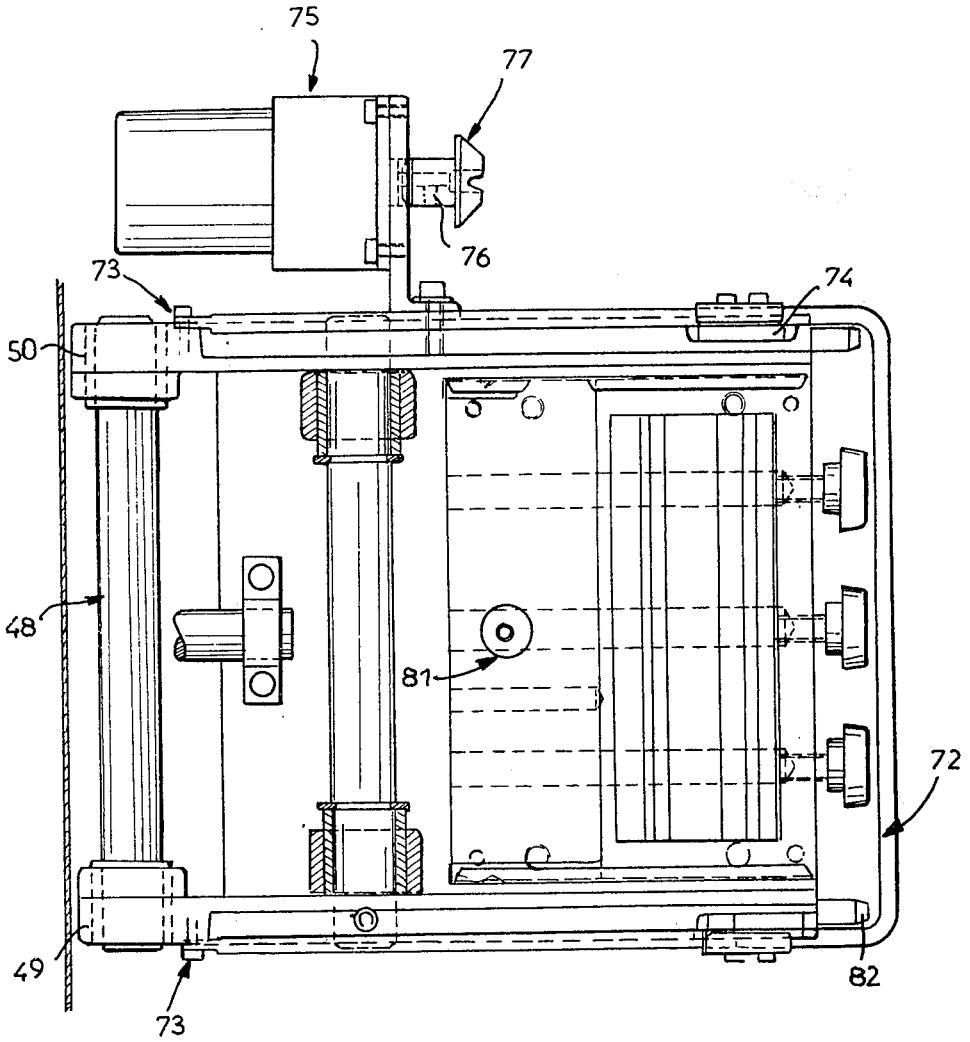
FIG. 3 is a view in section of the printing machine of the present invention, taken on the line III—III in FIG. 2.
Figure 4:
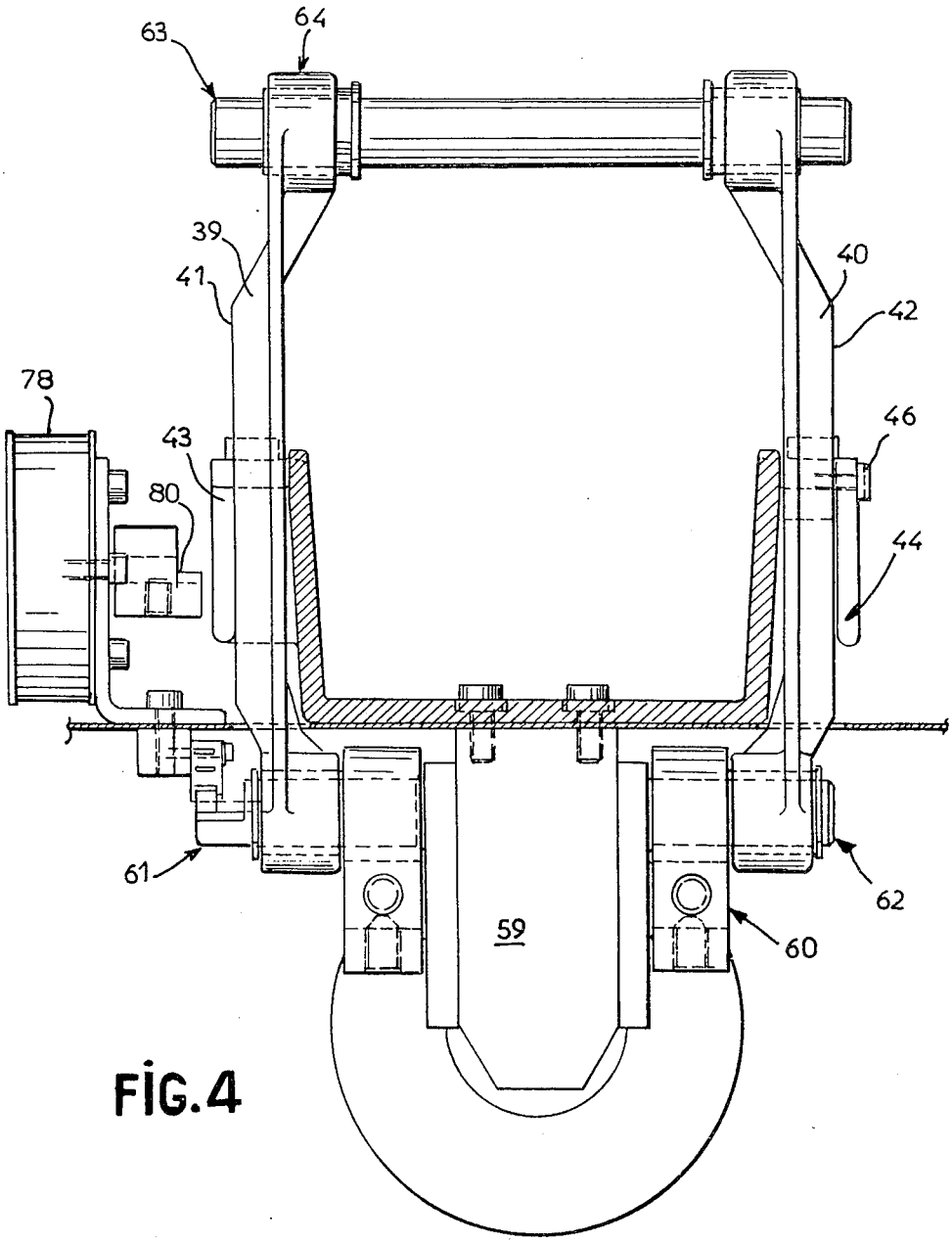
FIG. 4 is a view in section of the printing machine of the present invention, taken on the line IV—IV in FIG. 2.

The electric control circuit of the motor 58 is so arranged as to lower the head until it comes into contact with the fixed support and then to raise it to its position of rest corresponding to the position shown in FIG. 2. Whenever the sectional member 72 is touched the head will be stopped and then, after a brief time constant, raised to its position of rest.

A first motor-reduction gear unit 75 is fixed on one of the lateral sides of the movable head by means of screws. The shaft 76 of this motor-reduction gear unit 75 ends in a dog 77 permitting its coupling to the accessories which will be described later on with reference to FIGS. 5 to 9.

A second motor-reduction gear unit 78 is fixed to the frame 31 by screw bolts and nuts 79. The shaft of this motor-reduction gear unit 78 ends in a half-tongue 80 which cooperates with a half-tongue carried by a shaft of the accessories of the support; these will be described later on in connection with FIGS. 10 to 22.

The printing unit is provided on its bottom face with a magnet 81 which cooperates with an elastic tongue on the support, as will be described below in connection with FIGS. 10 to 22. The front face of the movable head is provided with studs 82 intended for fixing the accessories provided for the head.

Figure 6:
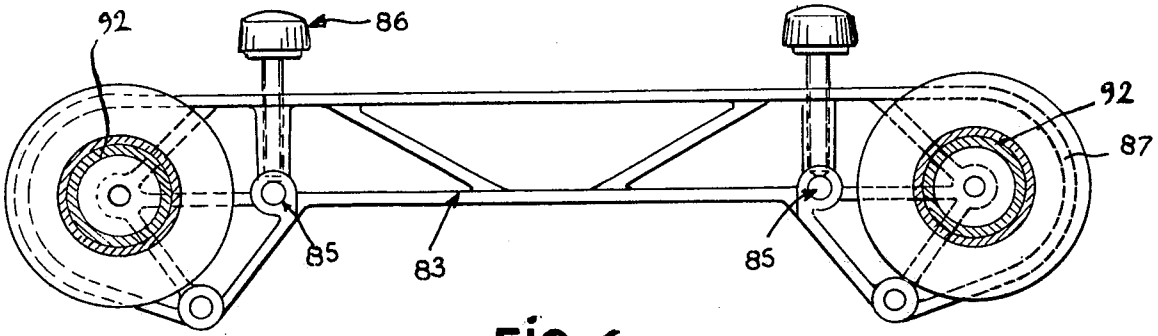
FIG. 6 is a view in section on the line VI—VI in FIG. 5.
Figure 5:
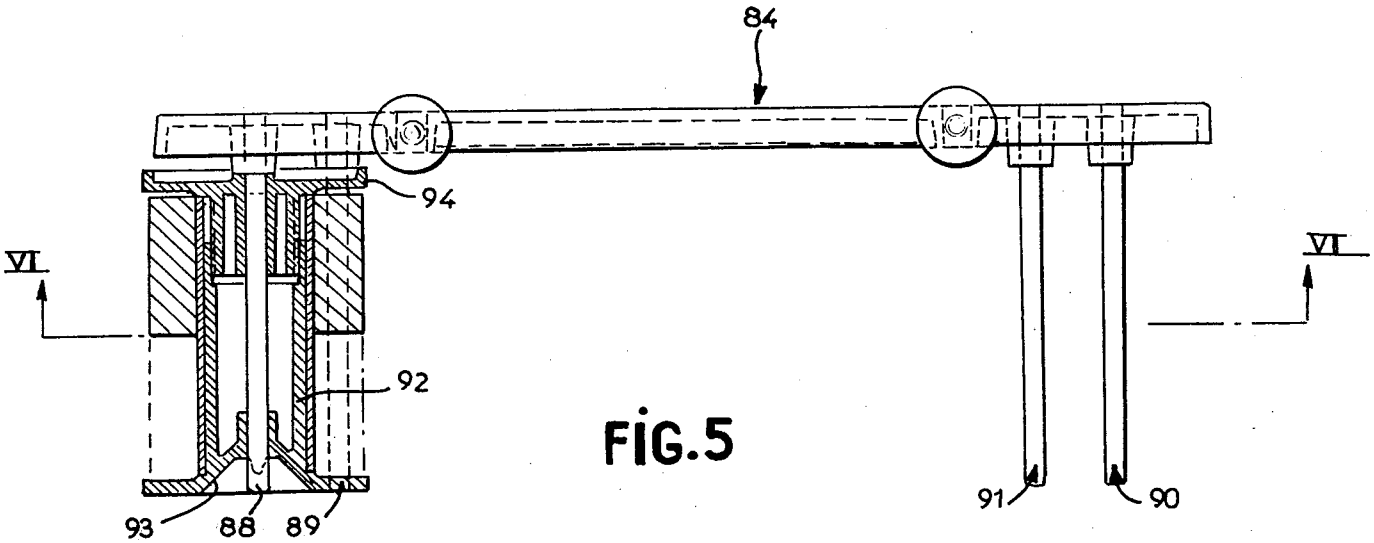
FIG. 5 is a view from above, partly in section, of an acccessory according to the present invention, serving to unwind a film at the movable head of the printing machine.

The first accessory for the movable head will now be described with reference to FIGS. 5 and 6; this is a device 83 for unwinding a film in front of the letterpress unit or block carrier unit. The film serves for example as support for a gilt strip intended to be deposited under heat in accordance with a certain model on the object to be printed. This unwinding device 83 comprises a central portion 84 and two side portions 87. The central portion has two holes 85 intended for the passage of the studs 82 on the front face of the movable head. This unwinding device is held in place on the studs with the aid of holding screws 86 which are locked against the said studs. The side parts 87 are provided with shafts 88, 89, 90, and 91. The shafts 89 and 91 do not support any rotating member, whereas the shafts 88 and 90 support spools 92 for the unwinding and winding up of the film. The driving spool 92 has been shown in FIGS. 5 and 6, and its end 93 is designed to cooperate with the dog 77 on the motor-reduction gear unit 75. The film, which passes from one spool to the other, slides over the shafts 89 and 91, which hold the film in position in relation to the letterpress unit or block carrier unit. The nose 94 of the spool 92 serves for the manual angular displacement of the said spool for the purpose of coupling it to the dog of the motor-reduction gear unit 75.

The inking device for the letterpress unit will now be described with reference to FIGS. 7, 8, and 9. It comprises four rollers 101, 102, 103, and 104, whose axes of rotation 105, 106, 107, and 108 are parallel to one another. The roller 101, which is of metal, is in contact with a container 109 formed by the angle between the roller and the frame 32. This roller 101 is driven rotationally in the direction of the arrow 110 by the pressure roller 102, which turns in the direction of the arrow 111 because of the rotation of the distributor roller 103 in the direction of the arrow 112. The rollers are driven by friction on their cylindrical surfaces. The inking roller 104 is in contact with the roller 103 only during certain periods of the operating cycle. The roller 101 is of metal, while the rollers 102, 103, and 104 are of synthetic material. The roller 101 is held against the container 109 and against the roller 102 by springs 113, which bear against the ends of the shaft 105. Contact pressure is adjusted by means of two adjusting screws acting on the springs 113. This roller 101 is not held in bearing rings but simply rests on the container and the roller 102.

The pressure roller 102 is mounted on the shaft 106 turning at one end of a ring 114 and at the other end on a shaft 115, which can be displaced axially with the aid of a knurled head 116 in order to permit the dismantling of the said roller.

The shaft 107 of the distributor roller 103 is mounted for rotation at one end on a shaft 117 which can be displaced axially by means of the knurled head 116 in order to permits dismantling. At the other end the shaft 107 is connected to a drive shaft 118 by means of a dog. The shaft 118 is connected to the motor-reduction gear unit 75 by two bevel pinions 119 and 120 for an angle drive. The motor-reduction gear unit 75, turning continuously, first drives rotationally the distributor roller 103, likewise called "motor roller", which in turn drives rotationally the rollers 102 and 101 and also the roller 104 when the latter comes into contact with the roller 103. This system of rollers therefore permits the inking of the roller 104, which turns on two connecting rods 121 and 122 articulated respectively at 123 and 124 on a movable support 125. Two pin type springs 126 and 127, whose turns are wound around a shaft 128, act between the movable support 125 and the connecting rods 121 and 122, urging the said connecting rods upwards in the direction of the arrow 129, so that the inking roller 104 is applied against the composed type contained in the letterpress unit. The ends of the connecting rods, at the level of the inking roller, terminate in a rounding which prevents any substantial vertical displacements of the roller on the composed matter.

The movable support 125 is articulated at 130 and 131 and receives its movement from a first rod 132, which is articulated at 133 on the support and which is fixed to a second rod 134 by a semi-elastic connection composed of guides 135 and 136 and a spring 137 acting between these two guides. The second rod 134 is articulated at 138 on the frame of the machine.

The movable support 125 and the inking roller 104 are dismantled by the axial displacement of the shaft 131 with the aid of the knurled rod 116, while the rod 132 can be unfastened from the support by unscrewing the knurled head screw 133.

Figure 7:
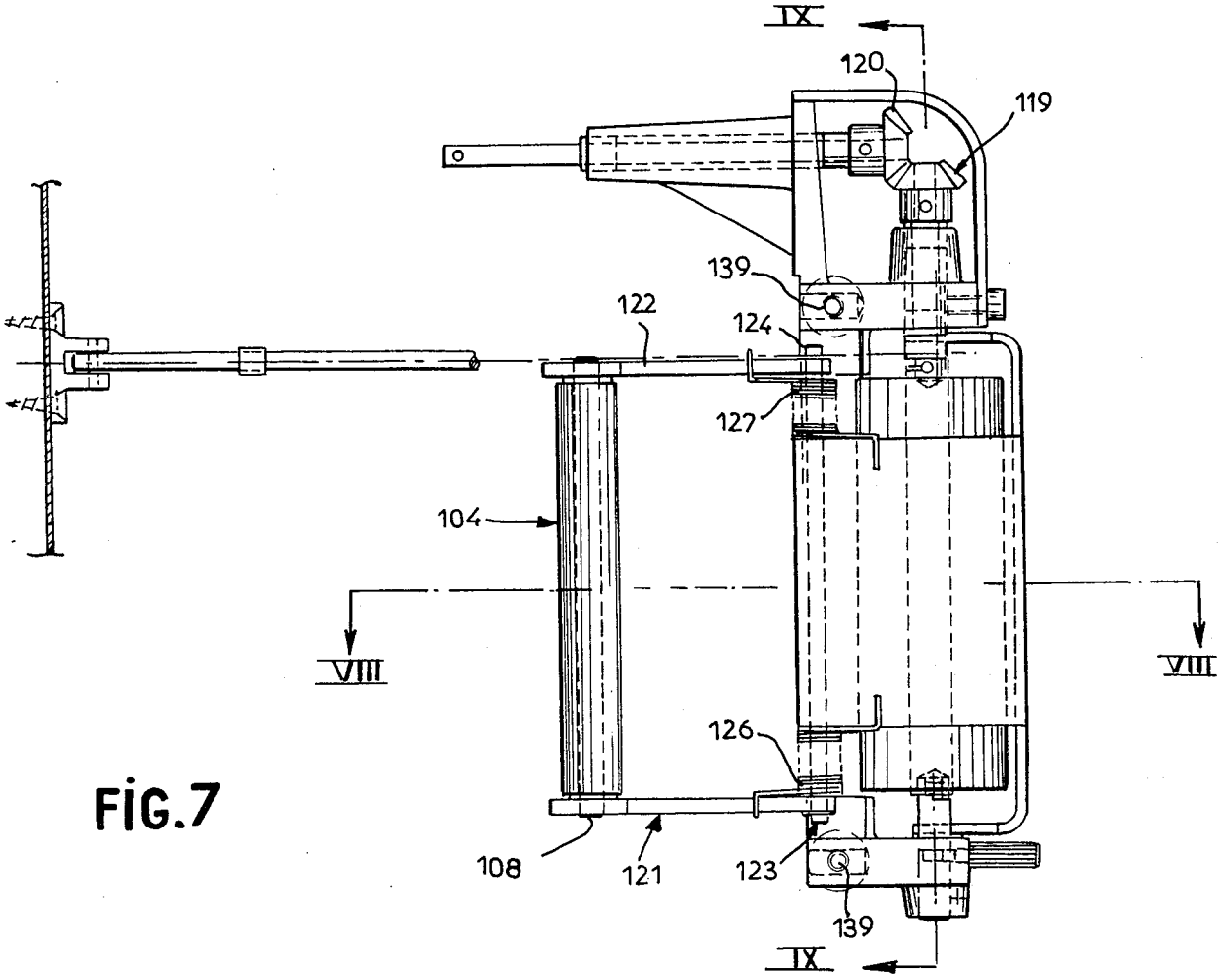
FIG. 7 is a view from below of an inking device according to the present invention, which fits on the movable head of the printing machine.
Figure 8:
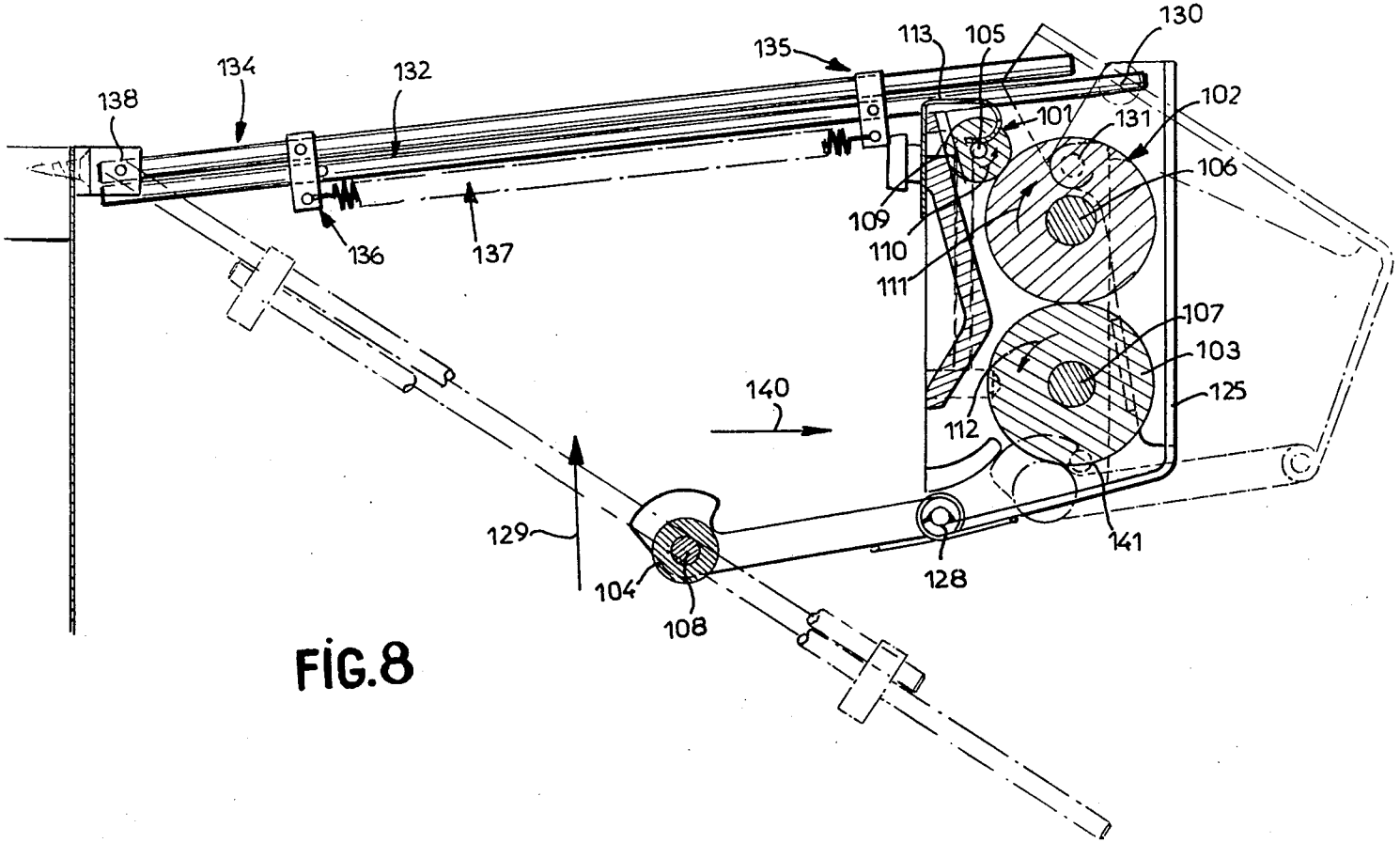
FIG. 8 is a view in section of the inking device, taken on the line VIII—VIII in FIG. 7.
Figure 9:
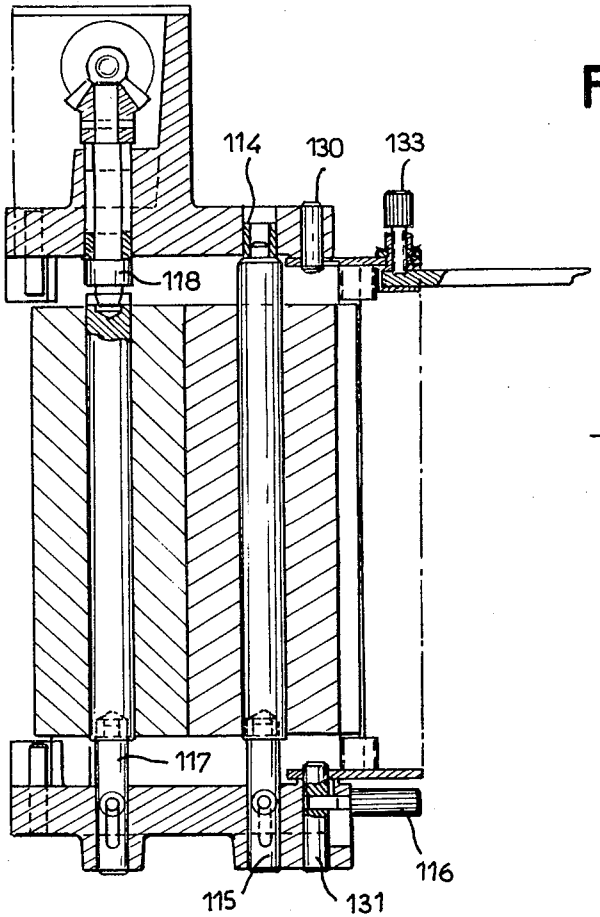
FIG. 9 is a view in section of the inking device, taken on the line IX—IX in FIG. 7.

The different elements of the inking device which has been described with reference to FIGS. 7, 8, and 9 are disposed in a unit which is fastened to the head by tightening two screws 139 on the studs 82 of the head.

At the commencement of the printing cycle the head is in the upper position and the position of the inking unit is that shown in FIG. 8. The inking roller 104 is in contact with the composed matter mounted in the letterpress unit. When the head is lowered, the arrangement comprising the rods 132,134 and the spring 137 pulls the movable support 125 in such a manner as to displace the inking roller in the direction of the arrow 140. The inking roller passes over the composed matter and comes to a stop against a pin 141, where it is in contact with the distributor roller 103 and is impregnated with ink. The head continues to move downwards until the inked composed matter presses against the sheet which is to be printed. When the head then rises again, the inking roller moves in the opposite direction over the composed matter and the cycle is completed when the head returns to its position of rest.

Figure 10:
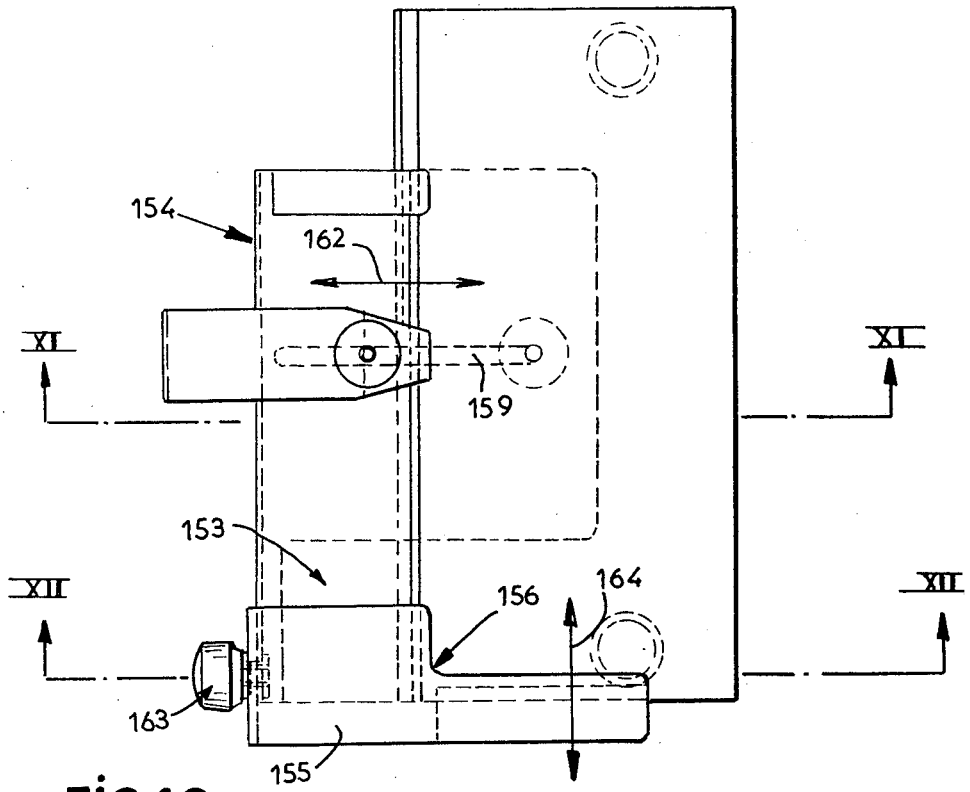
FIG. 10 is a view from above of an all-format platen intended for engaging in the support of the printing machine.
Figure 11:
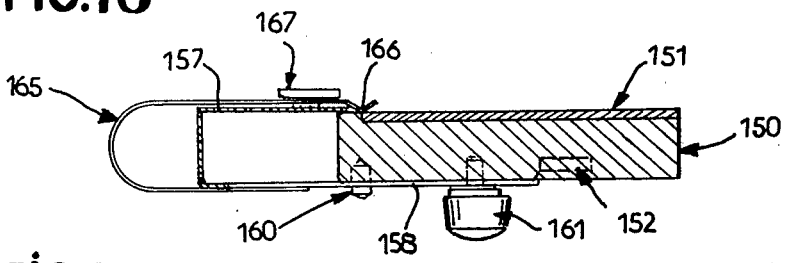
FIG. 11 is a view in section of the all-format platen, taken on the line XI—XI in FIG. 10.
Figure 12:
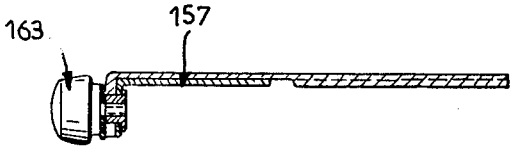
FIG. 12 is a view in section of the all-format platen, taken on the line XII—XII in FIG. 10.

The all-format platen will now be described with reference to FIGS. 10, 11, and 12. It is composed of a metal block 150 whose upper face is covered with a layer 151 of a synthetic material. The lower face is provided laterally with two circular sockets 152 intended to receive the heads of the cylindrical magnets 37 and 38 of the support 35. The block 150 is provided with a feeder 153 composed of two movable parts 154 and 155, which are joined together to form a right angle 156. The movable part 154 is U-shaped, the legs 157 and 158 of the U being adapted to slide respectively on the upper and lower faces of the block 150 in the directions indicated by the arrow 162. The leg 158 has an opening 159 which slides on a stud 160 carried by the lower face. A locking screw 161 passing through the slot enables the movable part to be held in position. At one end the base of the U is provided with an opening in which slides the locking screw 163 fastened to the other movable part 155, thus permitting displacement of the latter in relation to the first part 154 in the direction of the arrow 164. The movable part 154 is provided with an elastic metal member 165 which ends in a claw or pin on the upper face of the block 150. The claw 166 serves to hold on the block 150 the sheet of paper that is to be printed. The sheet of paper is released by raising the claw with the aid of a metal button 167 fastened to the spring 165, which cooperates with the magnet 81 of the movable head. The above description shows that it is possible to adapt the platen to all sizes of sheets to be printed, by displacing the movable parts 154 and 155 in the directions indicated by the arrows 162 and 164.

Figure 14:
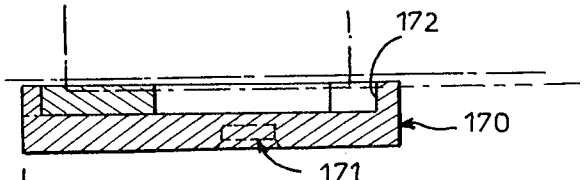
FIG. 14 is a view in section of the stamp platen taken on the line XIV—XIV in FIG. 13.
Figure 13:
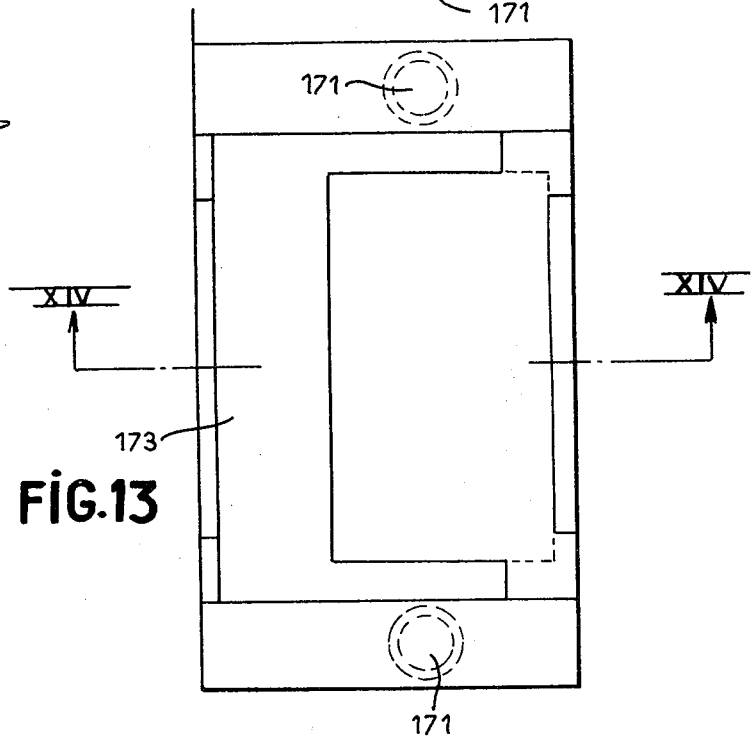
FIG. 13 is a view from above of a platen for stamp moulds which is intended to engage in the support of the printing machine.

FIGS. 13 and 14 show a modified form of platen for cases where the machine of the present invention is used for making moulds for stamps. The metal block 170 is provided on its lower face with two sockets 171 for the centring and holding magnets. Its upper portion is provided with a recess for the positioning of the vulcanising unit or rubber stamp. For sizes having dimensions smaller than those of the recess, provision is made for inserting a centring wedge 173 which is U-shaped.

Figure 15:
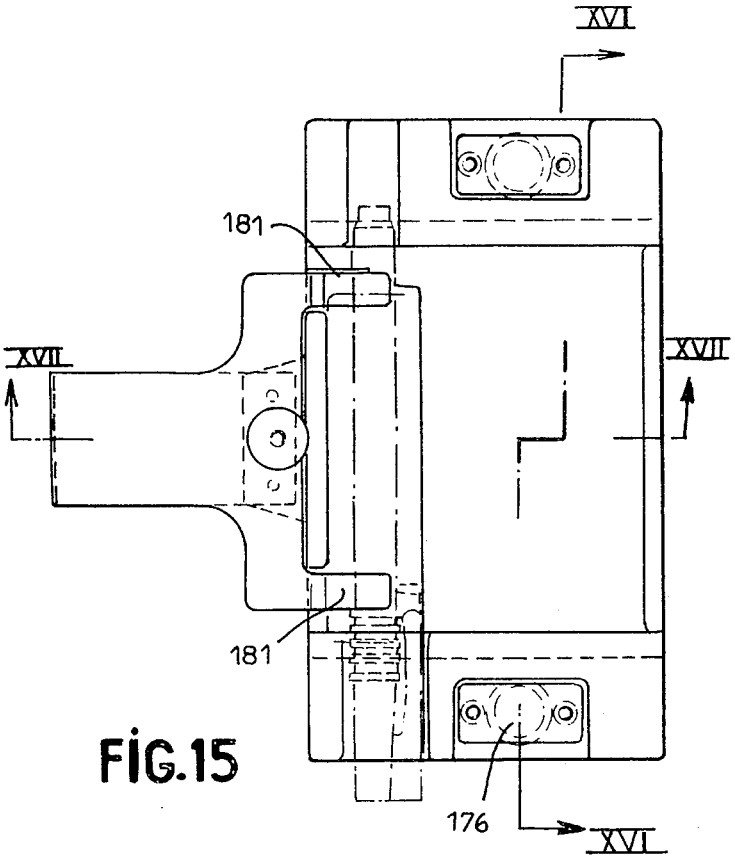
FIG. 15 is a view from above of a platen for various objects, which is intended to engage in the support of the printing machine.
Figure 16:
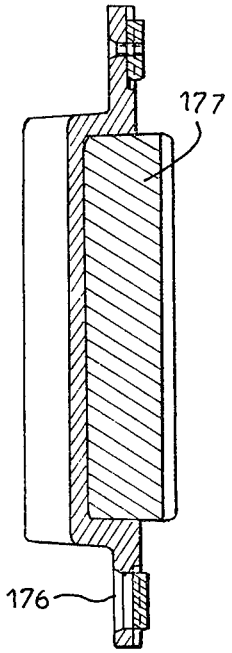
FIG. 16 is a view in section of the platen for various objects, taken on the line XVI—XVI in FIG. 15.
Figure 17:
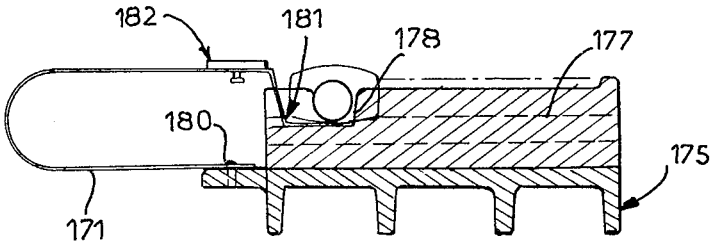
FIG. 17 is a view in section of the platen for various objects, taken on the line XVII—XVII in FIG. 15.

FIGS. 15, 16, and 17 show another modification of the platen where it is desired to print on various objects, such as lighters and pens. This platen comprises a metal block 175 intended to fit into the support, in which it is centred and held in position by the magnets 37 and 38 which cooperate with sockets 176 provided in the bottom face of the said support. The upper face of the block supports a block 177 of synthetic material fitted therein and provided with a deep cavity 178 over its entire length, this cavity being intended for receiving the objects to be printed. An elastic metal part or spring 179 has a bottom end which is fixed at 180 on the metal block 175 and two free upper ends 181 which take up position under the object to be printed. A metal button 182 is fastened to the top end of the spring 179 and cooperates with the magnet 81 of the movable head in such a manner as to raise the object printed on when the movable head returns to its position of rest, and to eject it from its groove.

Figure 18:
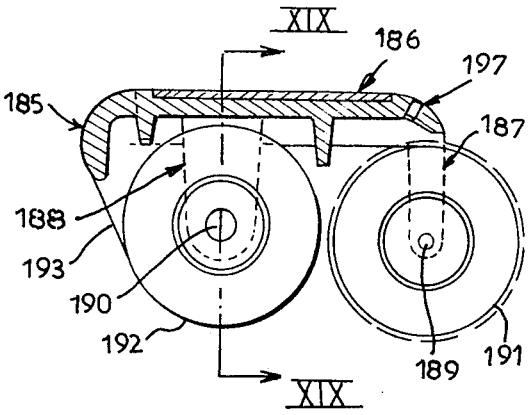
FIG. 18 is a view in section of a platen for adhesive labels, which is intended to engage in the support of the printing machine.
Figure 19:
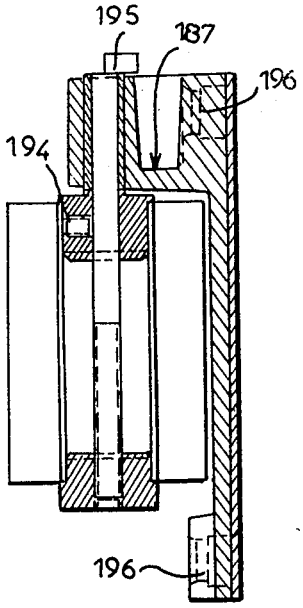
FIG. 19 is a view in section of the platen for adhesive labels, taken on the line XIX—XIX in FIG. 18.

FIGS. 18 and 19 show another modification of the platen, which is intended for the printing of adhesive labels which are disposed on a film. This modified embodiment consists essentially of an alloy block 185 fitting into the support, and of a device for the unwinding of the label support film. The alloy block 185 is provided with sockets 196 disposed on its lower face and cooperating with the magnets 37 and 38 of the support. The upper face of the block 185 is provided with a block 186 of synthetic material, on which the labels will rest at the moment of their printing. The block 185 is extended downwards, on one side only, by lateral arms 187 and 188 which serve to support the shafts 189 and 190 of the spools 191 and 192 on which the support film 193 is wound. The spool 191 turns freely on its shaft 189 and stores the film with the unprinted labels. The spool 192 is fastened to its shaft 190 by a screw 194, the shaft being driven rotationally by the motor-reduction gear unit 78 through the medium of a coupling by half tongues 195. The film 193 passes from the storage spool 191 to the driven spool 192 over the upper face of the metal block 185. As it passes, the film masks an optoelectronic device represented diagrammatically by a phototransistor 197 disposed on one edge of the metal block 185. This phototransistor 197 cooperates with holes or notches in the film and the electric signal which it supplies serves to stop the motor-reduction gear unit 78 when the phototransistor detects a hole or a notch.

The functioning of the device is then as follows: after the printing of the label which rests on the floor 186, the movable head is raised to return to its position of rest, and this movement gives rise to the operation of the motor-reduction gear unit 78 through the medium of a microswitch (not shown in the drawings). The film is therefore displaced in such a manner as to wind the printed label onto the spool 192 and to bring an unprinted label onto the floor 186. The motor-reduction gear unit 78, and therefore the film, stop when the phototransistor 197 detects a hole or a notch in the film, the holes or notches being spaced out suitably and regularly on the film so as to permit precise positioning of the label.

Figure 20:
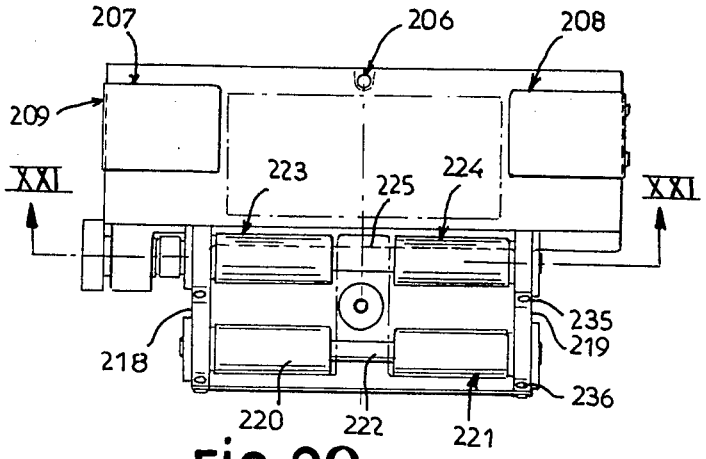
FIG. 20 is a view from above of a distributor charger for visiting cards, which is intended to engage in the support of the printing machine.
Figure 21:
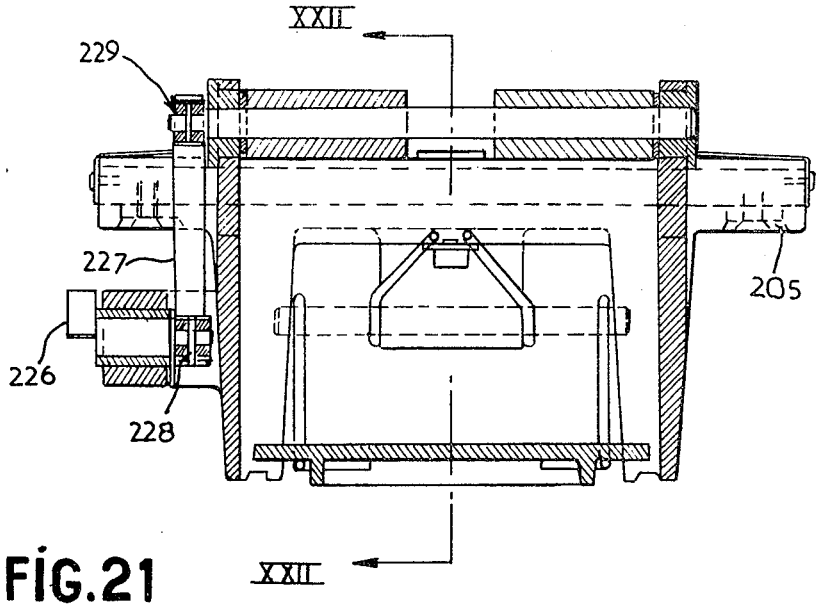
FIG. 21 is a view in section of the distributor charger for visiting cards, taken on the line XXI—XXI in FIGS. 20 and 22.
Figure 22:
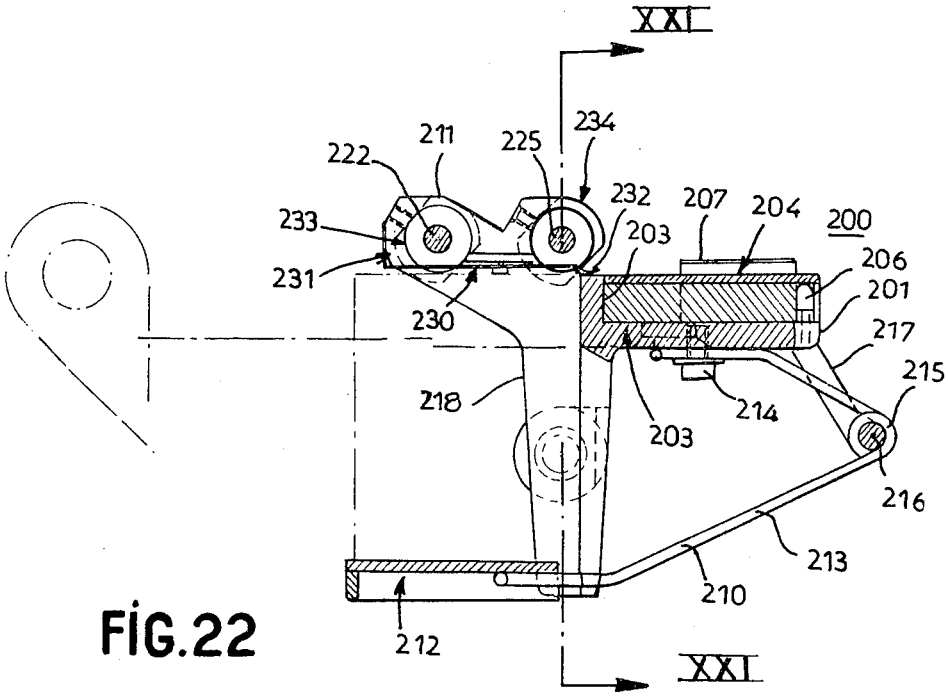
FIG. 22 is a view in section of the distributor charger for visiting cards, taken on the line XXII—XXII in FIG. 21.

FIGS. 20, 21, and 22 show a particular example of construction of a distributor charger for visiting cards 200, which is associated with a printing platen 201. The platen 201 comprises an alloy block 202 provided with a recess 203 containing a metal part covered by a layer 204 of synthetic material. The bottom face of the block 202 has centring sockets 205 cooperating with the centring and holding magnets of the support. A photoelectric cell 206 is disposed in the middle of that side edge of the block 202 which is opposite to the side edge adjacent to the distributor charger 200. The other two side edges of the block 202 each carry an elastic tongue 207,208 held by rivets 209, the free end of each tongue tending to move away from the upper face of the block 202.

The distributor charger 200 comprises a charging device 210 for visiting cards and a distributor device 211 for the said cards. The charging device 210 is composed of a plate 212 articulated on the free ends of a pin type spring 213. The other end of the spring 213 is fixed on the bottom face of the block 202 by a screw 214. The turns 215 of the spring 213 are wound around a shaft 216 which is fastened to the block 202 by means of an arm 217. The magazine of the charger is composed of the space contained between the plate 212 and the inlet of the distributor, which inlet is situated at the level of the upper face of the block 202. The stack of cards contained in the magazine is held laterally by side plates 218 and 219 fastened to the block 202. These side plates 218 and 219 are also extended upwards in order to serve as support for the different elements of the card distributor.

The elements of the card distributor comprise a first pair of carrier rollers 220 and 221 which turn on a shaft 222, and a second pair of driving rollers 223 and 224 which are fastened to a rotating shaft 225. This shaft 225 is driven rotationally by the motor-reduction gear unit 78 with the aid of a connection comprising a assembly 226 of two half-tongues, a belt 227, and two pulleys 228 and 229. On each shaft 222 and 225 the rollers are separated by a gap designed to permit the passage of the magnet 81 of the movable head. This magnet 81 cooperates with a metal button fastened on an elastic tongue 230, of which one end 231 is fixed to the side plates 218 and 219, while the other end 232 is free and ends in a lug bearing against the upper face of the block 202. The shafts 222 and 225 of the rollers are held in bearings mounted in eccentrics 233 to 236. The rotation of the eccentrics permits adjustment of the vertical position of the rollers in dependence on the thickness of the visiting cards to be printed.

The functioning of the distributor charger is then as follows: the rollers 223 and 224 drive by friction the top card of the stack towards the block 201, and it passes under the end 232 of the elastic tongue. When the card escapes from the rollers it continues to advance through the action of its inertia and the slope of the platen, and is freed from the magazine. The next card is presented under the rollers and as it advances it pushes the preceding card, which then masks the photoelectric cell 206. The masking of the cell 206 triggers on the one hand the stopping of the motor-reduction gear unit 81 and on the other hand the commencement of the printing cycle. The raising of the movable head after the printing of the card gives rise to the raising of the end 232 of the tongue 230 on the one hand, and to the starting up of the motor-reduction gear unit 78 for the placing in position of the next card, on the other hand. The elastic tongues 207 and 208 are provided in order to prevent the film from adhering to the cards in the case of dry printing.

The magazine is loaded by withdrawing the distributor charger assembly from it support; the plate 212 is then brought into the bottom position by placing the free ends of the spring 213 in bosses 237 provided for the purpose. A stack of cards can then be introduced and then the ends of the spring 213 can be placed back under the plate 212.

The printing machine according to the present invention has been described in connection with particular examples of construction of the basic machine and of its different accessories which are fitted either on the movable head or on the support, but it is clear that those versed in the art can make modifications to the embodiments described without departing from the scope of the present invention.

What is claimed is:

1. In a printing machine which comprises a movable printing head and a support for the objects to be printed, the said head being designed for displacement and to come into contact with the object to be printed, the improvement wherein:

the movable head comprises a frame which pivots about an axis situated in a plane passing through the support and fastened to the latter and which is connected to a motor-reduction gear unit driving through the medium of a system of connecting rods and cranks, the said frame carrying an electric heating plate, a first rapid attachment device which makes it possible to bring into thermal contact with the heating plate a printing unit adapted for the printing work which is to be done, and a second rapid attachment device for placing in position accessories suitable for the work to be done, and the support for objects to be printed comprises a frame fixed to the frame of the machine and adapted to receive different platens according to the type of object to be printed, the said frame of the support being provided with centring and holding means for the platen and means for removing the said platen.

2. A machine as claimed in claim 1, wherein said first rapid attachment device of the printing unit is composed of slides fastened to the heating plate.

3. A machine as claimed in claim 1, wherein said heating plate is mounted on the frame of the movable head with the aid of a semi-elastic connection which permits truing of the printing unit in relation to the platen and the adjustment of the pressure at the moment of printing.

4. A machine as claimed in claim 1, wherein said second rapid attachment device for the accessories is provided with two studs which cooperate with holes and holding screws on the accessory.

5. A machine as claimed in claim 1, wherein said frame of the movable head is also provided with a device for ensuring the safety of the operator.

6. A machine as claimed in claim 5, wherein said safety device comprises a sectional member surrounding the frame and pivoting about an axis, the said sectional member cooperating with microswitches in such a manner as to stop the motor-reduction gear unit driving the frame of the head in the event of the sectional member being touched.

7. A machine as claimed in claim 1, wherein said platen centring and holding means comprise magnets cooperating with metal sockets in the platen.

8. A machine as claimed in claim 1, wherein said means for removing the said platen are composed of levers of which one end takes up position under the platen in such a manner as to lift it from its frame of the support when the operator manipulates the other end of the levers.

9. A printing machine as claimed in claim 1, wherein said platen comprises:

a metal block provided with centring sockets cooperating with said centring means of the support, a variable position feeder, and a device for the temporary holding of the sheets which are to be printed.

10. A printing machine as claimed in claim 9, wherein said variable position feeder consists a first U-shaped part adapted to be displaced parallely to a first dimension of the block and a second part which is adapted to be displaced in relation to the first part in a direction perpendicular to the first dimension and along the base of the U, these two movable parts cooperating with studs and locking screws.

11. A printing machine as claimed in claim 10, wherein said device for the temporary holding of the sheets to be printed consists of an elastic tongue of which one end is fixed on the first movable part while the other end comes to bear against the edge of the sheet to be printed, the said tongue carrying a metal button which cooperates with a magnet carried by the movable head.

12. A printing machine as claimed in claim 1 in which said platen comprises an alloy block which is provided with centring sockets cooperating with said centring and holding means of the support, the said block having a recess in its upper portion in such a manner as to receive the vulcanising unit and a centring wedge.

13. A printing machine as claimed in claim 1, which said platen comprises a metal block which is provided with centring sockets cooperating with the centring and holding means of the support, the said block having a recess in its upper portion in such a manner as to receive therein a block of synthetic material which has a cavity designed for the placing in position of the object to be printed, and a device for the ejection of the object to be printed.

14. A printing machine as claimed in claim 13, wherein said device for ejecting the object to be printed is composed of an elastic tongue of which one end is fixed to the metal block, while the other end takes up position in the cavity under the object, the said tongue carrying a metal button cooperating with a magnet on the movable head in such a manner as to lift the free end of the tongue after the printing.

15. A printing machine as claimed in claim 1, wherein said platen is a film unwinding platen comprising an insertable block which is provided with centring sockets cooperating with said centring and holding means of the support, two arms supporting, in the first case a label film storage spool which turns freely on a shaft and, in the second case, a receiving spool parallel to the first spool and driven rotationally by a motor-reduction gear unit fastened to the support, and an optoelectronic device for stopping the label film.

16. A printing machine as claimed in claim 1, in which said platen for the loading and distribution of visiting cards which comprises an insertable block provided with centring sockets cooperating with said centring and holding means of the support, and a distributor charger fastened to the insertable block and comprising a variable position visiting card support and a distributor for the said cards coming from the card support.

17. A printing machine as claimed in claim 16, wherein said visiting card support is composed of a support plate articulated to the free end of a pin type spring whose fixed end is fastened to the insertable block, the turns of the said spring surrounding a shaft which is likewise fastened to the insertable block.

18. A printing machine as claimed in claim 16, wherein the card distributor is composed of two parallel rollers supported by side plates fastened to the insertable block, one of the said rollers turns freely about a shaft while the other is driven rotationally by a motor-reduction gear unit fixed to the support of the machine; of an elastic member holding the visiting card on the insertable block and cooperating with the magnet of the movable head, and an optoelectronic device for detecting a visiting card on the block in such a manner as to stop the motor-reduction gear unit as soon as a card is in position for printing.

19. A printing machine as recited in claim 1 wherein one of said accessories is a film unwinding accessory which comprises a longitudinal member carrying the holes and the holding screws which cooperate with the studs of the frame of the head, two spools which are designed to receive a film, and which are mounted for rotation on shafts carried by each end of the longitudinal member, one of the spools serving for storage and turning freely on its shaft and the other receiving the used film which has passed in front of the printing unit and being driven rotationally by a motor-reduction gear unit fixed to the frame of the movable head.

20. A printing machine as recited in claim 1 wherein one of said accessories is an accessory for the inking of said printing unit which accessory comprises on the one hand, a support carrying the holes and the holding screws cooperating with the studs of the frame of the movable head, the said support carrying three parallel rollers, of which one, which is driven rotationally by a motor-reduction gear unit fixed to the frame of the movable head, drives by friction the other two rollers, of which one is in contact with the letterpress ink contained in a container, while the other is in contact with the driving roller and with the roller in contact with the ink, and on the other hand a system of articulated rods with springs of which one end is fixed to the frame of the machine while the other end carries an inking roller which, when the head is in the position of rest, is at one end of the printing unit and is displaced on the printing unit when the head moves towards the support for the objects to be printed, and which comes into contact with the roller after a certain angular displacement of the head.

* * * * *